US006189229B1

(12) United States Patent
Thomas et al.

(10) Patent No.: US 6,189,229 B1
(45) Date of Patent: Feb. 20, 2001

(54) HAIR DRYER HOLDER

(76) Inventors: Andrew P. Thomas; Anne Marie Thomas, both of One Wagon Trail Rd., Chelmsford, MA (US) 01824

( * ) Notice: Under 35 U.S.C. 154(b), the term of this patent shall be extended for 0 days.

(21) Appl. No.: 09/335,036

(22) Filed: Jun. 16, 1999

(51) Int. Cl.[7] ..... F26B 19/00
(52) U.S. Cl. ..... 34/90; 34/96
(58) Field of Search ..... 34/90, 91, 96, 34/97; 248/659, 660, 278, 288.11, 288.31, 288.51, 481

(56) References Cited

U.S. PATENT DOCUMENTS

| | | | | |
|---|---|---|---|---|
| D. 313,314 | | 1/1991 | Gaboriault et al. | D8/366 |
| D. 314,502 | | 2/1991 | Weldin | D8/373 |
| D. 374,312 | | 10/1996 | Edgar | D28/73 |
| 4,225,106 | | 9/1980 | Eplan | 248/309 |
| 4,453,695 | * | 6/1984 | Sennott et al. | 248/660 |
| 4,712,313 | | 12/1987 | Gettleman | 34/97 |
| 4,746,090 | | 5/1988 | Hamilton | 248/314 |
| 5,174,531 | | 12/1992 | Perakis | 248/124 |
| 5,613,305 | * | 3/1997 | Narrin | 34/90 |
| 5,842,670 | | 12/1998 | Nigoghosian | 248/160 |
| 5,857,263 | | 1/1999 | Chan | 34/97 |
| 5,937,537 | * | 8/1999 | Miller | 34/97 |
| 5,956,861 | * | 9/1999 | Barnes | 34/90 |
| 6,061,923 | * | 5/2000 | Case | 34/90 |

* cited by examiner

*Primary Examiner*—Pamela Wilson
(74) *Attorney, Agent, or Firm*—Pennie & Edmonds LLP

(57) ABSTRACT

A hair dryer holder for adjustably holding a hair dryer, comprising a base for attaching the hair dryer holder to a surface, an extension member including a bottom portion fixed to the base and an arm member extending from the base, and a universal joint member coupled to the arm member and comprising a ball member juxtaposed between two cup members for rotation therein, the ball member configured for coupling to a nozzle of a hair dryer such that the nozzle can be positioned by the ball member.

15 Claims, 2 Drawing Sheets

HAIR DRYER HOLDER

FIELD OF THE INVENTION

The present invention generally relates to a novel holder for adjustably holding a hair dryer.

BACKGROUND OF THE INVENTION

Hair dryers are well-known and widely-used appliances. Although hair dryers are used by millions of consumers everyday, they remain an awkward appliance to use simply because the user is generally using a brush and/or a comb concurrently. In order to simplify the use of hair dryers, many have attempted to create hair dryer holders to free the user's hands. However, because of the unusual and different shape of most hair dryers, the holders have not met the user's needs.

U.S. Pat. No. 4,225,106 discloses an apparatus for supporting an electrical hair dryer. The apparatus includes a bracket having an arm that pivots and a holder having a slot and a yoke that is pivotly attached to the arm. The dryer is supported in the holder by placing the hand grip of the dryer in the slot and the barrel of the dryer in the yoke. Resilient straps secure the dryer in place.

U.S. Pat. No. 4,712,313 discloses a portable hair dryer holder designed to hold a hair dryer, allowing a person to use their two free hands on their hair.

U.S. Pat. No. 4,746,090 discloses an adjustable holder device for a hand-held hair dryer that allows rotational and vertical movement of the hair dryer. The device comprises a holder member that holds the hair dryer on one end and attaches to a base on the other end. A wall mount base is provided for permanent attachment to a wall that has a means for receiving the holder member in varying vertical positions.

U.S. Pat. No. 5,174,531 discloses a hair dryer holder apparatus that is fully adjustable for releasably holding a hair dryer. The holder includes a horizontal ring base and a pair of spaced vertical telescoping posts, the upper ends of which include a hinged pair of adjustable arms angled generally towards each other. The arms have grippers which releasably hold the hair dryer at the handle and the nozzle.

U.S. Pat. No. 5,842,670 discloses an apparatus for supporting an electrical hair dryer. The apparatus includes a base from which projects a flexible tube. The other end of the tube includes a hair dryer holder. The flexible tube may be positioned into any of a number of various orientations.

U.S. Pat. No. 5,857,263 discloses a hair drying apparatus comprising a hair dryer holder, a power cord retainer, and a base. The holder allows the hair dryer to be removable, adjustable in height, and securably positioned. The base contains a power cord retainer and may be mounted on a wall.

U.S. Pat. Nos. D313,341, D374,312, and D374,312 disclose various designs for a hair dryer holder. U.S. Pat. No. D314,502 discloses a design for an adjustable hair dryer holder.

Although there are numerous means for holding a hair dryer disclosed in the art, there remains a need for a hair dryer holder that allows universal mounting (e.g., a wall, a mirror, a table, or a sink) while simultaneously providing a universal range of positions available for securing the hair dryer.

SUMMARY OF THE INVENTION

The present invention is directed to a hair dryer holder for adjustably holding a hair dryer, comprising a base for attaching the hair dryer holder to a surface, an extension member including a bottom portion fixed to the base and an arm member extending from the base, and a universal joint member coupled to the arm member. The universal joint member includes a ball member juxtaposed between two cup members for rotation therein, the ball member configured for coupling to a nozzle of a hair dryer such that the nozzle can be positioned by the ball member.

In one embodiment, the ball member includes an aperture for receiving the hair dryer nozzle and is comprised of an elastomeric material such that the ball aperture is flexible to fit different diameter hair dryer nozzles. In another embodiment, the cup members have cup apertures of a first diameter and the ball aperture has a second diameter that is sufficiently smaller than the first diameter such that the ball has at least 15 degrees of rotation within the cup members when a hair dryer is secured thereto. In a further embodiment, the universal joint member is coupled to the arm member to rotate relative thereto.

Preferably, the ball aperture has about 15 to 35 degrees of rotation. In another embodiment, the universal joint member has at least about 180 degrees of rotation. In a preferred embodiment, the universal joint member has at least about 180 to 270 degrees of rotation.

In another embodiment, the base is a suction cup, a c-clamp, a weighted base, a mounting plate, a clamp, or a telescoping stand and base. In a preferred embodiment, the base is a suction cup that can be mounted on a flat surface such as a horizontal counter or a vertical mirror. Preferable, the ball member includes an adjustable clamp for receiving the nozzle of a hair dryer and an extender juxtaposed between the clamp and ball member. In another embodiment, the extension member is partial C-shaped.

The present invention is also directed to a hair dryer holder for adjustably holding a hair dryer, comprising an attachment means for attaching the hair dryer holder to a surface and a holder means for holding the hair dryer in a location extended from the attachment means. The holder means includes a means for coupling to a nozzle of a hair dryer and fixing the hair dryer in one of a range of universal positions, enabling the user to direct air flow from the hair dryer from any one of said positions.

In one embodiment, the attachment means is releasably attachable to the surface. In another embodiment, the holder means is portable by a user for use at different locations. In a further embodiment, the holding means is omni-directionally rotatable within a predetermined range. In still another embodiment, the holder means is coupled to the extension means such that it has about at least about 180 degrees of rotation in a first plane. Preferably, the extension means is coupled to the base such that it has at least about 180 degrees of rotation in a second plane substantially perpendicular to the first plane.

The present invention is also directed to a kit for drying hair comprising a hair dryer having a handle and a nozzle, and a hair dryer holder for adjustably holding a hair dryer, comprising a base for attaching the hair dryer holder to a surface, an extension member including a bottom portion fixed to the base and an arm member extending from the base, and a universal joint member to the arm member and comprising a ball member juxtaposed between two cup members for rotation therein, the ball member configured for coupling to the nozzle of the hair dryer such that the nozzle can be positioned by the ball member.

The present invention is further directed to a method of drying hair comprising providing a hair dryer having a handle and a nozzle; providing a hair dryer holder for adjustably holding a hair dryer, the holder comprising a base for attaching the hair dryer holder to a surface, an extension member including a bottom portion fixed to the base and an arm member extending from the base, and a universal joint member to the arm member and comprising a ball member juxtaposed between two cup members for rotation therein, the ball member configured for coupling to the nozzle of the hair dryer such that the nozzle can be positioned by the ball member; securing the base of the hair dryer holder to the surface for convenient hair dryer holding; mounting the hair dryer in said hair dryer holder by securing the nozzle of the hair dryer within the ball member and cup members; and rotating the extension member and the universal joint member to selectively position the hair dryer in any one of a predetermined universal position for optimal drying of a user's hair.

DESCRIPTION OF THE PREFERRED EMBODIMENTS

Figure 1:
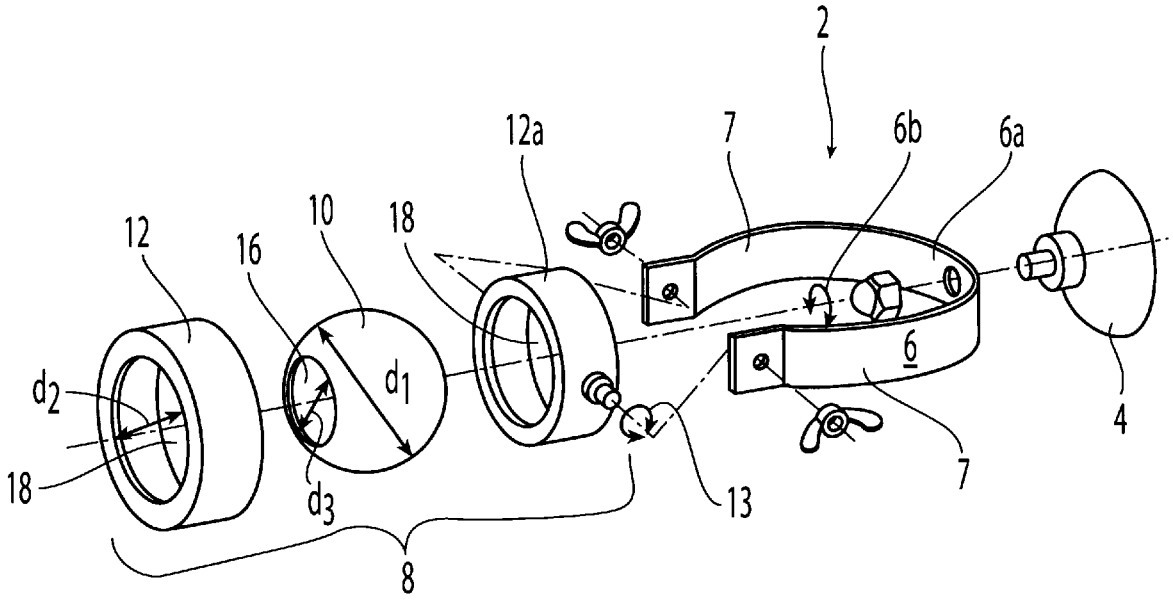
FIG. 1 is an exploded perspective view of the components that comprise a preferred embodiment of the hair dryer holder according to the present invention.
Figure 2:
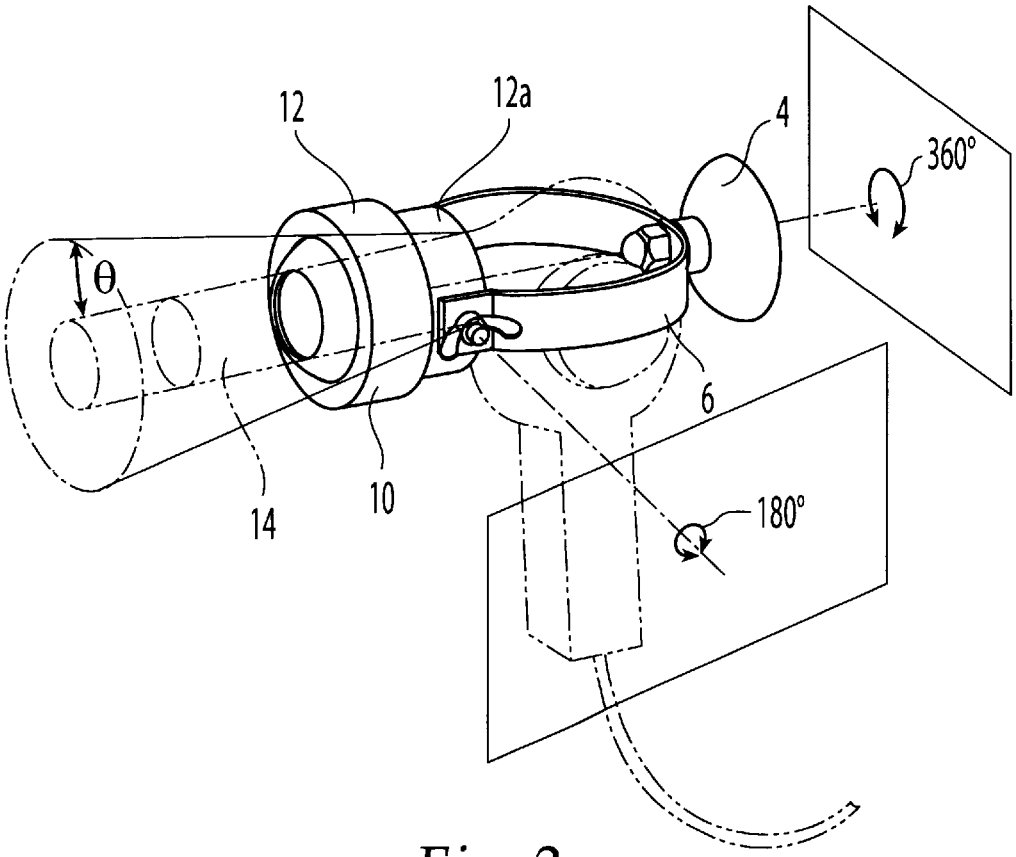
FIG. 2 is a view of the components of FIG. 1 in assembled position with a hair dryer (in phantom outline) held in place therein.

Referring to FIGS. 1 and 2, the present invention is directed to a hair dryer holder 2 and a means for adjustably holding a hair dryer, comprising a base 4 for attaching the hair dryer holder to a surface, an extension member 6 including a bottom portion 6*a* secured to the base and two arm members 7 extending from the base. A universal joint member 8 is coupled between the arm members and comprises a ball member 10 juxtaposed between two cup members 12 and 12*a* for rotation therein, the ball member having a ball aperture 16 for receiving a nozzle of a hair dryer 14.

The base 4 of the hair dryer holder 2 comprises any means that allows secure, but preferably removable, attachment of the holder to any one of a number of surfaces or structures, e.g., a counter top, a mirror, a wall, or a sink. The base 4, for example, might comprise a suction cup, a c-clamp, a mounting plate, a clamp, a telescoping stand and weighted base, or a combination thereof. Preferably, the base 4 of the hair dryer holder 2 is a suction cup that allows releasable attachment to a variety of surfaces.

Attached to the base 4 is an extension member 6 that preferably includes a bottom portion 6*a* secured to the base 4 and, additionally, at least one arm member 7 and, preferably, two arm members 7 extending away from the base 4. The extension member 6 is preferably securely attached to the base 4 via means such as the combination of a bolt and a wing nut or a nut. The extension member 6 is preferably attached in a manner that allows swivelling of the member about the central axis through the base 4, as indicated by arrow 6*b*. The two arm members 7 should extend away from the base 4 at least a distance far enough to allow positioning of a universal joint member 8 coupled between the arm members 7 for receiving a hair dryer 14. The extension member 6 may be of unitary or multi-component construction and may be any one of a number of shapes, e.g., U-shaped, horseshoe-shaped, or V-shaped, or materials, e.g., metal, plastic or polymeric, or hard rubber. The extension member 6 is preferably a light-weight metal, U-shaped, and of unitary construction.

The universal joint member 8 is coupled between the arm members 7 and acts to receive a hair dryer 14 and to provide a means for rotation and securing of the hair dryer 14 position. The universaljoint member 8 is coupled to the arm member 7 using any one of a number of means, such as screws, rivets, or bolts with nuts or wing nuts, and preferably rotates relative to the member, i.e., around the axis connecting it to the arm members 7, as indicated by arrow 13. The rotatability of the extension member 6 about the base and the universal joint member 8 about the arm members 7, as indicated in FIG. 1 by rotation in the direction of arrows 6*b* and 13, respectively, provide a universal-type connection between these components. This enables the nozzle of a hair dryer 14, positioned in the holder 2, to assume a wide range of universally-variable positions, from which hot air is optimally aimed at the user's hair. Preferably, the universal joint member 8 is secured with wing nuts that allow it to be lockable in any predetermined position. The universal joint member 8 can rotate at least about 180 degrees, such that the nozzle of the hair dryer can at least point in either direction along the axis extending from the base. Preferably, the universal joint member 8 can rotate about 180 to 270 degrees.

Preferably, the universal joint member 8 comprises a ball member 10 juxtaposed between two cup members 12 and 12*a*. The ball member 10, which contains an aperture 16 for receiving the hair dryer 14, has a diameter, $d_1$, and may be constructed with any one of numerous flexible materials, such as rubber, plastic, or an elastomeric material. Preferably, the ball member 10 comprises an elastomeric material such that the ball aperture 16 is flexible enough to fit different diameter hair dryer nozzles. The material of the ball member 10 must be sufficiently heat-resistant so as to not be altered in shape or composition by the heat given off by the hair dryer 14.

The cup members 12 and 12*a* are preferably constructed of a material that cooperates with the material of the ball member 10 to minimize frictional resistance and allow for rotation of the ball member 10 within the cup members 12 and 12*a*. The cup members 12 and 12*a* may be of a material comprising metal, plastic, hard rubber, a thermoset material, or a combination thereof. The cup members 12 and 12*a* both include apertures 18 having a diameter, $d_2$, and the ball member 10 includes an aperture 16 having a diameter, $d_3$. The second diameter, $d_3$, is sufficiently smaller than the first diameter, $d_1$, such that the ball member 10 has at least about 15 degrees of rotation ($\Theta$) about an axis extending from the base 4 of the holder 2 (See, e.g., FIGS. 1 and 2), within the cup members 12 and 12*a* when a hair dryer 14 is secured by their combination. The cup members 12 and 12*a* do not necessarily have the same aperture diameter in order to allow for rotation of the ball member 10. For example, the cup member 12*a* that is coupled to the arm members 7 could have a smaller diameter than the aperture in cup member 12, but the aperture diameter must still be larger than the diameter, $d_3$, of the aperture 16 in ball member 10 such that the ball member 10, when secured with the nozzle of the hair dryer 14, still allows for rotation within the two cup members 12 and 12*a*. Additionally, the diameter, $d_1$, of the ball member 10 is preferably greater than the apertures 18 of the cup members 12 and 12*a* such that it is contained within said members. The ball member 10, when holding a hair dryer, precesses about the central axis of the holder 2 (as indicated by arrow 6*b* in FIG. 1) by at least about 15 degrees ($\Theta$, FIG. 2). Preferably, the ball member 10 has at about 15 to 35 degrees of rotation, about the central axis of the holder 2.

Figure 3:
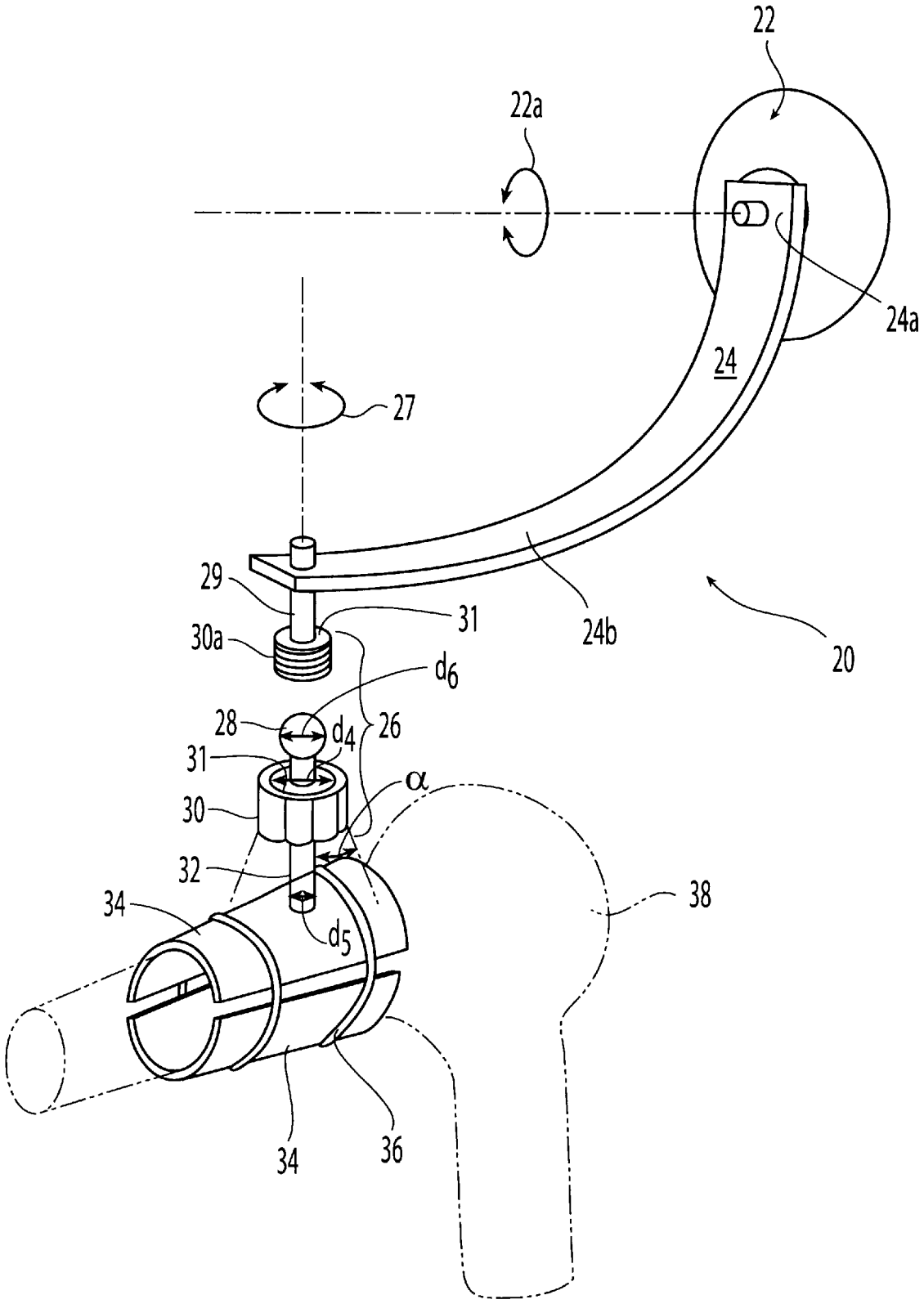
FIG. 3 is a perspective view of a second embodiment of the hair dryer holder according to the present invention.

Referring to FIG. 3, another embodiment of the present invention is directed to a hair dryer holder 20 and a means for adjustably holding a hair dryer, comprising a base 22 for attaching the hair dryer holder to a surface, an extension member 24 including a bottom portion 24*a* secured to the base, and an arm member 24*b* extending from the base. A universal joint member 26 is coupled to the arm member and comprises a ball member 28 juxtaposed between two cup members 30 and 30*a* for rotation therein.

The base 22 of the hair dryer holder 20 comprises any means that allows secure, but preferably removable, attachment of the holder to any one of a number of surfaces or structures, e.g., a counter top, a mirror, a wall, or a sink. The base 22, for example, might comprise a suction cup, a c-clamp, a mounting plate, a clamp, a telescoping stand and weighted base, or a combination thereof. Preferably, the base 22 of the hair dryer holder 20 is a suction cup that allows releasable attachment to a variety of surfaces.

Attached to the base 22 is an extension member 24 that preferably includes a bottom portion 24*a* secured to the base 22 and, additionally, at least one arm member 24*b* extending away from the base 22. The extension member 24 is preferably securely attached to the base 22 via means such as the combination of a bolt and a wing nut or a nut. The extension member 24 is preferably attached in a manner that allows swivelling of the member about the central axis through the base 22, as indicated in FIG. 3 by arrow 22*a*. The arm member 24*b* should extend away from the base 22 at least a distance far enough to allow positioning of a universal joint member 26 coupled to the arm member 24*b* for coupling to a hair dryer 38. The extension member 24 may be a unitary arm of a multi-component construction. Preferably, the extension member 24 is a curved arm such that a line tangent to one end is approximately perpendicular to a line tangent to the opposite end. The arm can be made from any sufficiently strong material, e.g., metal, plastic or polymeric, or hard rubber. The extension member 24 is preferably a light-weight metal, partial C-shaped, and of unitary construction.

The universal joint member 26 is coupled to the arm member 24*b* by connector 29 and acts to provide a means for rotation. The connector 29 is coupled to the arm member 24*b* using any one of a number of means, such as screws, rivets, or bolts with nuts or wing nuts, and preferably rotates relative to the member, e.g., around the axis connecting it to the arm member 24*b*, as indicated in FIG. 3 by arrow 27. The rotatability of the extension member 24 about the base 22, and the universal joint member 26 about the arm member 24*b*, allows rotation in the direction of arrows 22*a* and 27, respectively, providing a universal-type connection between these components. This enables the universal joint member 26 to assume a wide range of universally-variable positions, from which the hot air of an attached hair dryer 38 is optimally aimed at the user's hair. Preferably, the universal joint member 26 is secured with wing nuts that allow it to be lockable in any predetermined position. The universal joint member 26 can rotate about 360 degrees about the axis co-linear to connector 29 (See arrow 27, FIG. 3).

Preferably, the universal joint member 26 comprises a ball member 28 juxtaposed between two cup members 30 and 30*a*. The ball member 28, which includes a clamp extension 32 and nozzle clamp 34 for receiving the hair dryer 38, may be constructed with any one of numerous flexible materials, such as rubber, plastic, or an elastomeric material.

The cup members 30 and 30*a* are preferably constructed of a material harder than the material of the ball member 28 to minimize frictional resistance and allow for rotation of the ball member 28 within the cup members 30 and 30*a*. The cup members 30 and 30*a* may be of a material comprising metal, plastic, hard rubber, a thermoset material, or a combination thereof. The cup members 30 and 30*a* both include apertures 31 having a diameter, $d_4$, and the clamp extender 32 has a diameter, $d_5$. The diameter, $d_5$, of the clamp extender 32 is sufficiently smaller than the aperture diameter, $d_4$, of the cup members 30 and 30*a* such that the ball member 28 has at least about 15 degrees of rotation ($\alpha$), away from and about an axis co-linear to the connector 29 (See arrow 27, FIG. 3) within the cup members 30 and 30*a*. The cup members 30 and 30*a* do not necessarily have the same aperture diameter in order to allow for rotation of the ball member 28. For example, the cup member 30*a* that is coupled to the arm member 24*b* via the connector 29 could have a smaller diameter than the aperture in cup member 30, but should remain larger than the diameter of the clamp extender 32 to allow for the desired rotation within the cup members 30 and 30*a*. Additionally, the ball member 28 has a diameter, $d_6$, that is greater than the aperture 31 of the cup members 30 and 30*a* such that the ball member 28 is contained within said members. The ball member 28, precesses about the axis co-linear to connector 29 (See arrow 27, FIG. 3) by at least about 15 degrees ($\alpha$).

The clamp extender 32 is connected to the nozzle clamp 34, preferably a hollow cylinder divided along its longitudinal axis, the two halves of the cylinder held together about the nozzle of the hair dryer 38 by an adjustable means, e.g. elastic bands, o-rings, velcro straps, or cable ties. Preferably, the nozzle clamp is held together with a plurality of o-rings 36. The adjustable means should be strong enough as to securely hold the hair dryer within the clamp 34 and flexible enough to allow stretching such that a range of nozzle sizes may be held. Preferably, the nozzle clamp 34 comprises a material that is sufficiently heat-resistant so as to not be altered in shape or composition by the heat given off by the hair dryer 38.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed:

1. A hair dryer holder for adjustably holding a hair dryer, comprising:

a base for attaching the hair dryer holder to a surface;

an extension member including a bottom portion fixed to the base and an arm member extending from the base; and a universal joint member coupled to the arm member and comprising a ball member juxtaposed between two cup members for rotation therein, the ball member configured for coupling to a nozzle of a hair dryer such that the nozzle can be positioned by the ball member.

2. The hair dryer holder of claim 1, wherein the ball member includes an aperture for receiving the hair dryer nozzle and is comprised of an elastomeric material such that the ball aperture is flexible to fit different diameter hair dryer nozzles.

3. The hair dryer holder of claim 2, wherein the cup members have cup apertures of a first diameter and the ball aperture has a second diameter that is sufficiently smaller than the first diameter such that the ball has at least 15 degrees of rotation within the cup members when a hair dryer is secured thereto.

4. The hair dryer holder of claim 1, wherein the universal joint member is coupled to the arm member to rotate relative thereto.

5. The hair dryer holder of claim 3, wherein the ball aperture has about 15 to 35 degrees of rotation.

6. The hair dryer holder of claim 1, wherein the universal joint member has at least about 180 degrees of rotation in a first plane.

7. The hair dryer holder of claim 6, wherein the universal joint member has at least about 180 to 270 degrees of rotation.

8. The hair dryer holder of claim 6, wherein the extension member is coupled to the base such that it has at least about 180 degrees of rotation in a second plane substantially perpendicular to the first plane.

9. The hair dryer holder of claim 1, wherein the base is at least one of a suction cup, a c-clamp, a mounting plate, a clamp, a weighted base, and a telescoping stand and base.

10. The hair dryer holder of claim 9, wherein the base is a suction cup.

11. The hair dryer holder of claim 1, wherein the extension member is U-shaped.

12. The hair dryer holder of claim 1, wherein the ball member includes an adjustable clamp for receiving the nozzle of a hair dryer and an extender juxtaposed between the clamp and ball member.

13. The hair dryer holder of claim 12, wherein the extension member is partial C-shaped.

14. The hair dryer holder of claim 1, wherein the base is releasably attached to the surface.

15. The hair dryer holder of claim 1, wherein the base is portable by a user for use at different locations.

* * * * *